United States Patent [19]

Miki et al.

[11] Patent Number: 4,653,367

[45] Date of Patent: Mar. 31, 1987

[54] APPARATUS FOR CUTTING RIBBED BARS OR THE LIKE INTO DESIRED LENGTHS

[75] Inventors: Toshiyuki Miki, Sagamihara; Kunio Tomioka, Kawasaki; Terushige Sakurai, Komatsu; Masao Nakajima, Matsuto, all of Japan

[73] Assignees: Kabushiki Kaisha Komatsu Seisakusho; Aoki Corporation, both of Tokyo, Japan

[21] Appl. No.: 768,003

[22] Filed: Aug. 21, 1985

[30] Foreign Application Priority Data

Aug. 23, 1984 [JP] Japan ..... 59-126972[U]

[51] Int. Cl.[4] ..... B26D 7/06

[52] U.S. Cl. ..... 83/156; 83/157; 83/261; 83/282; 83/436; 83/423

[58] Field of Search ..... 83/156, 157, 261, 282, 83/436, 423; 198/732, 624

[56] References Cited

U.S. PATENT DOCUMENTS

| | | | |
|---|---|---|---|
| 331,453 | 12/1885 | Shipps | 83/436 |
| 1,746,032 | 2/1930 | Ely | 83/261 X |
| 2,701,013 | 2/1955 | Klasing | 83/261 X |
| 3,331,488 | 7/1967 | Wellman | 198/624 |
| 3,889,565 | 6/1975 | Vecchi | 83/261 X |

*Primary Examiner*—James M. Meister
*Assistant Examiner*—John L. Knoble
*Attorney, Agent, or Firm*—Armstrong, Nikaido, Marmelstein & Kubovcik

[57] ABSTRACT

Two pairs of opposed feed rolls are rotatably mounted on the upstream and downstream sides, respectively, of a bar cutting mechanism with respect to the predetermined traveling direction of the bar. Each feed roll pair comprises a fixed feed roll on one side of the bar and a movable feed roll on the other side, with the movable feed roll being movable toward and away from the fixed feed roll. A drive mechanism constantly rotates each pair of opposed feed rolls, so that the bar is fed only when being pressed against the fixed feed roll by the movable feed roll. The feed roll pair on the downstream side of the cutting mechanism is further jointly movable laterally of the path of the bar against the force of a spring for lessening the load exerted thereon, and for preventing the bending of the bar, when the bar is being cut by the cutting mechanism. Each feed roll may be provided with a multiplicity of teeth arranged circumferentially thereon and resiliently biased radially outwardly for positive engagement with a regular pattern of ribs on the bar.

2 Claims, 9 Drawing Figures

APPARATUS FOR CUTTING RIBBED BARS OR THE LIKE INTO DESIRED LENGTHS

BACKGROUND OF THE INVENTION

Our invention relates to apparatus for cutting bars or the like into any required lengths. The bar cutting apparatus of our invention is particularly well suited for cutting reinforcing steel bars having ribs formed in a recurring pattern thereon, among other types of bars or like elongate objects. Hereinafter in this specification and in the claims appended thereto, we will use the word "bar" generically, to mean any elongate objects that can be handled by the apparatus.

The cutting of a bar exactly into required lengths requires the precese feeding of the successive required bar lengths into and through a cutting mechanism. Conventional expedients to this end have been either a stop adjustably movable for terminating the travel of the bar at a desired distance, or a pusher which pushes the bar a desired distance in coaction with a fluid actuated stop cylinder. These prior art devices are unsatisfactory in that they impose limits on the bar length that can be fed at one time, since the positions of the bar stop means are variable over a limited distance only.

SUMMARY OF THE INVENTION

We have hereby made possible, without use of stop means, the exact, positive feeding of a bar over any required distance for cutting the bar into any required length, no matter how great the total length of the bar may be.

The bar cutting apparatus in accordance with our invention comprises two pairs of opposed feed rolls, one disposed upstream, and the other downstream, of a cutting mechanism with respect to a predetermined traveling direction of a bar to be cut. Each pair of feed rolls are opposed to each other across the path of the bar, and one of the feed rolls is movable toward and away from the other. The downstream pair of feed rolls are further both mounted on a slide base which normally holds the feed rolls in proper working positions under the force of a spring or like resilient means and which is movable laterally of the path of the bar against the spring pressure. Also included is a drive mechanism for constantly imparting rotation to each pair of feed rolls in opposite directions.

Thus, extending between the upstream pair of feed rolls, the bar is fed into and through the cutting mechanism only when pressed against the fixed feed roll by the movable feed roll. The movable feed roll may be moved away from the fixed feed roll when a desired length of the bar is fed through the cutting mechanism. After being cut off by the cutting mechanism, this desired bar length can be transported away from the cutting mechanism on being pressed against the fixed one of the downstream pair of feed rolls by the movable one thereof. As the cutter cuts the bar by shearing action, the force transmitted to the downstream pair of feed rolls via the bar can be alleviated as these feed rolls conjointly travel laterally of the bar against the force of the resilient means.

As will have been seen from the foregoing, the cutting apparatus of our invention controlls the feeding of the bar by moving one of each pair of feed rolls toward and away from the other. The bar may therefore be fed any desired distance. It will also be appreciated that, notwithstanding the compactness of its construction, the apparatus of our invention can handle bars of any desired total length.

Preferably, the inventive apparatus may be put to use for cutting reinforcing steel bars having a recurrent pattern of ribs formed thereon. Each feed roll may then be furnished with a plurality or multiplicity teeth arranged circumferentially thereon and biased radially outwardly. The resiliently yieldable teeth will then make positive engagement with the ribbed bar, making it possible to feed the bar with little or no slip.

The above and other features and advantages of our invention and the manner of realizing them will become more apparent, and the invention itself will best be understood, from a study of the following description and appended claims, with reference had to the attached drawings showing a preferable embodiment of our invention.

DESCRIPTION OF THE PREFERRED EMBODIMENT

General

Figure 1:
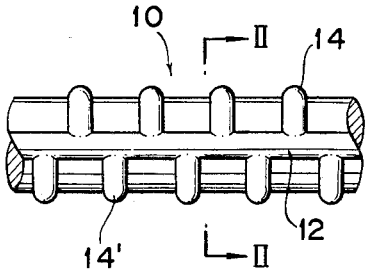
FIG. 1 is an elevation of a ribbed reinforcing steel bar to be cut by the apparatus of our invention.
Figure 2:
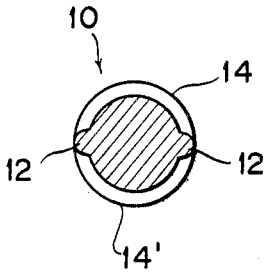
FIG. 2 is a cross section through the bar of FIG. 1, taken along the line II-II therein.

The cutting apparatus in accordance with our invention is particularly well suited for cutting a reinforcing steel bar 10 shown in FIGS. 1 and 2. Generally of circular cross section, the bar 10 has formed thereon a pair of diametrically opposed ribs 12 extending longitudinally thereof, and two rows of semicircular transverse ribs 14 and 14' linking the longitudinal ribs 12 in staggered relation to each other.

Figure 3:
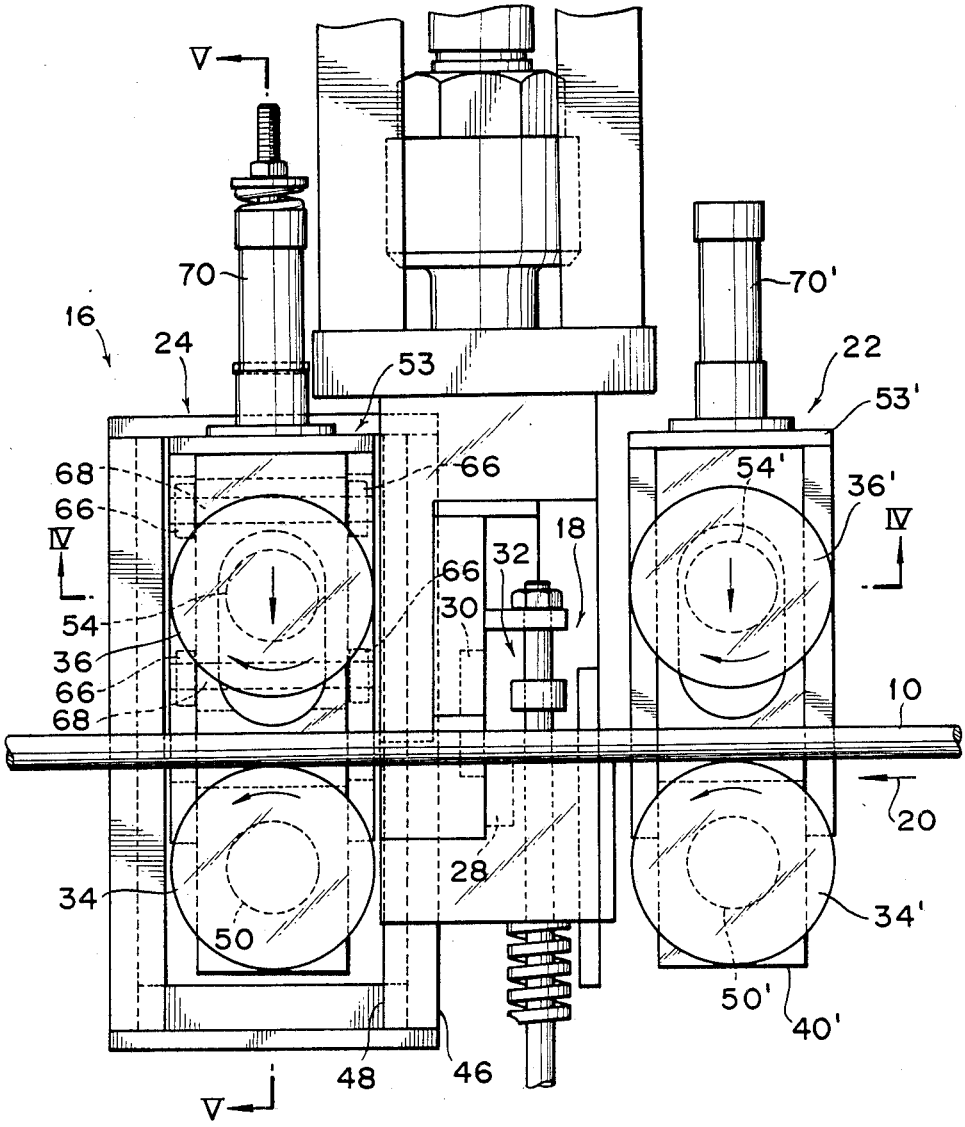
FIG. 3 is a top plan of the bar cutting apparatus constructed in accordance with the novel concepts of our invention and adapted for cutting the bar of FIGS. 1 and 2.
Figure 4:
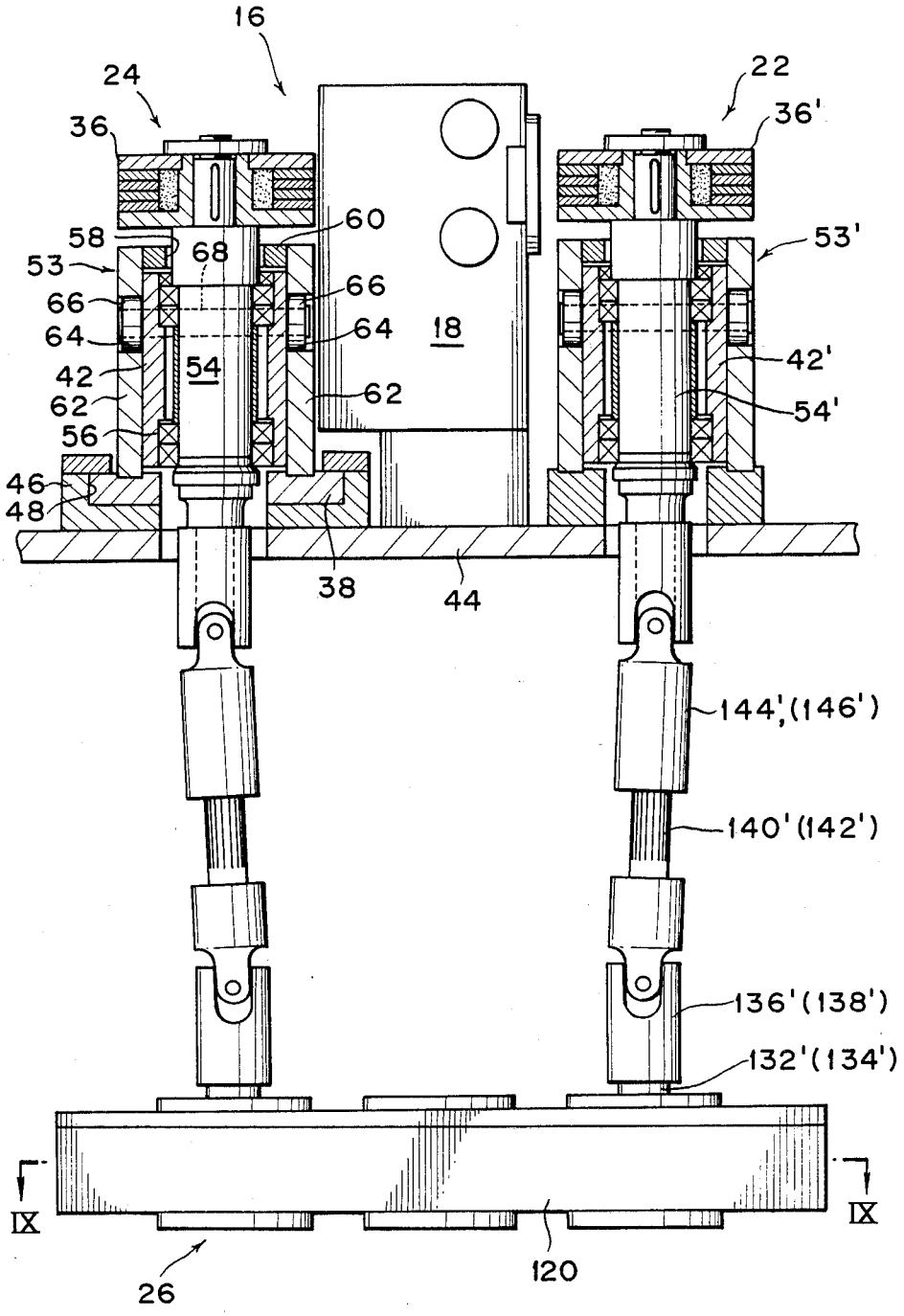
FIG. 4 is a vertical section through the bar cutting apparatus of FIG. 3, taken along the line IV—IV therein.
Figure 5:
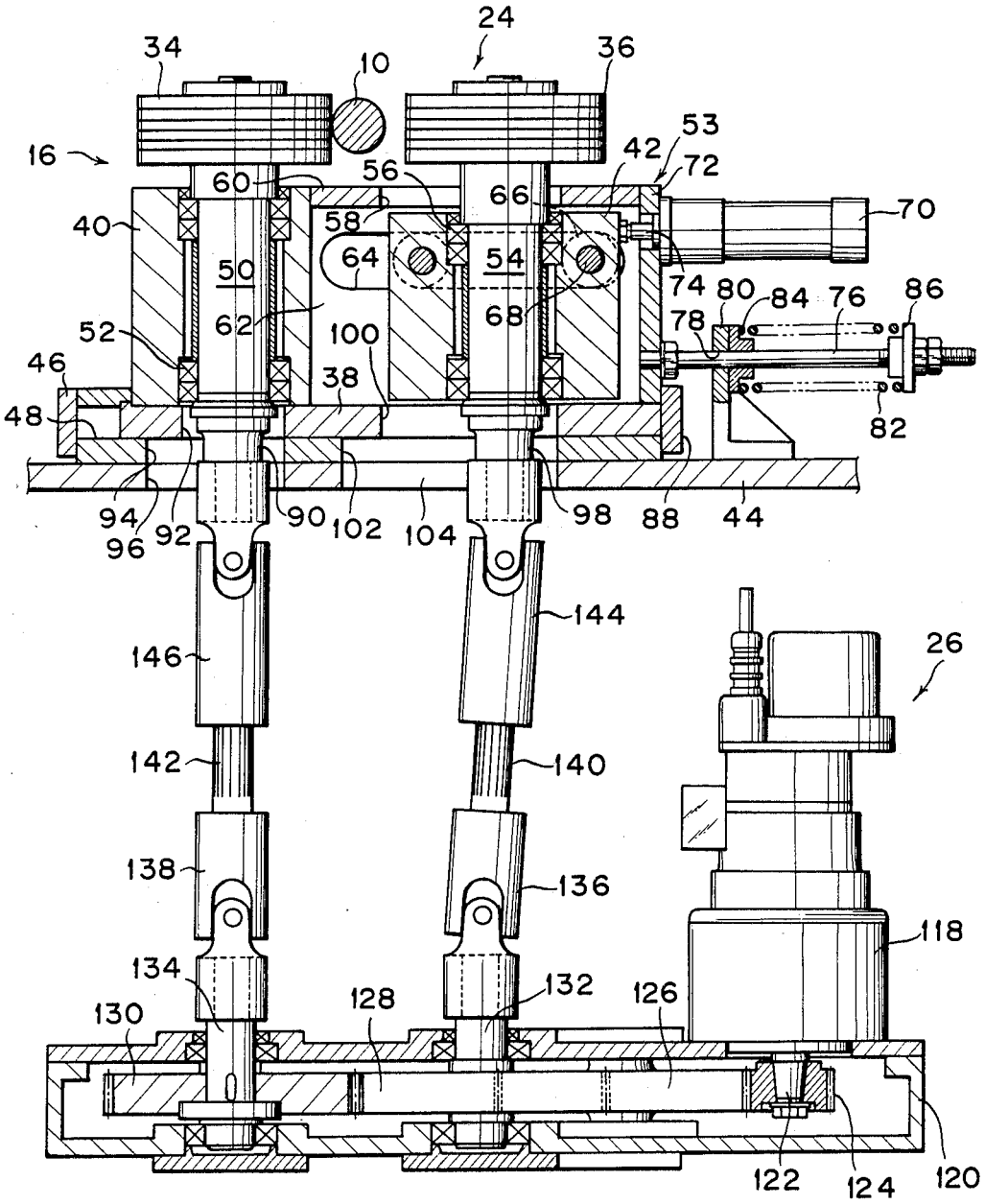
FIG. 5 is also a vertical section through the bar cutting apparatus of FIG. 3, taken along the line V—V therein.

We have illustrated in FIGS. 3 through 5 the apparatus, generally designated 16, for cutting the ribbed bar 10 of FIGS. 1 and 2 into any desired lengths. The bar cutting apparatus 16 broadly comprises:

1. A cutting mechanism 18 for cutting the bar 10 as the latter is fed into and through the cutting mechanism in a predetermined direction, indicated by the arrow 20 in FIG. 3, along a predetermined path.

2. A first feed mechanism 22 disposed on the upstream side of the cutting mechanism 18 with respect to the predetermined direction 20 of bar travel and feeding successive required lengths of the bar 10 into and through the cutting mechanism.

3. A second feed mechanism 24 disposed on the downstream side of the cutting mechanism 18 with respect to the predetermined direction 20 of bar travel for transporting the successive severed lengths of the bar 10 away from the cutting mechanism.

4. A drive mechanism 26, FIGS. 4 and 5, for driving the two feed mechanisms 22 and 24.

Given hereafter are more extensive discussions of the above listed cutting mechanism 18, feed mechanisms 22 and 24, and drive mechanism 26, under the respective headings, followed by the operational description of the complete bar cutting apparatus 16.

Cutting Mechanism

The cutting mechanism 18 can be of conventional design and therein lies no feature of our invention. We will therefore describe the cutting mechanism 18 to an extent necessary for a full understanding of the cutting apparatus 16. As shown in FIG. 3, the cutting mechanism 18 comprises a fixed cutter 28 disposed on one side of the predetermined path of bar travel, and a movable cutter 30 disposed on the other side of the bar path. At 32 is shown a bar holder mechanism for firmly holding the bar 10 as the movable cutter 30 is actuated to sever the bar in coaction with the fixed cutter 28.

Feed Mechanisms

The two feed mechanisms 22 and 24 can be of identical organization, only with the exceptions to be set forth presently. Accordingly, we will describe only the downstream side feed mechanism 24 as same is better illustrated in FIGS. 4 and 5, with the understanding that the same description applies, except where we will specifically indicate, to the upstream side feed mechanism 22. We will identify the various parts of the upstream side feed mechanism 22 merely by priming the reference numerals used to denote the corresponding parts of the downstream side feed mechanism 24. We will also explain the differences of the upstream side feed mechanism 22 from the downstream side feed mechanism 24 after the detailed description of the latter.

With reference to FIGS. 3 through 5 the downstream side feed mechanism 24 comprises a pair of feed rolls 34 and 36 opposed to each other across the predetermined path of the bar 10. The feed rolls 34 and 36 are both rotatably mounted on a slide base 38 for joint travel therewith in a transverse direction of the bar path. Further, while the feed roll 34 is rotatably supported by a roll support 40, FIG. 5, rigidly mounted on the slide base 38, the other feed roll 36 is rotatably supported by a carriage 42 movable on the slide base transversely of the bar path. The feed roll 36 is thus movable toward and away from the feed roll 34, besides being movable therewith as above. We will therefor refer to the feed roll 34 as the fixed feed roll, and the other feed roll 36 as the movable feed roll.

At 44 in FIGS. 4 and 5 is shown a platform on which is fixedly mounted a guide 46 adapted to define a guideway 48 extending transversely of the bar path. The slide base 38 is slidably engaged in the guideway 48. Mounted fast on the slide base 38, the roll support 40 rotatably supports an upstanding shaft 50 via bearings 52. The shaft 50 protruding upwardly of the roll support 40 and has the fixed feed roll 34 nonrotatably mounted on its protruding top end.

Also rigidly mounted on the slide base 38 is a boxlike guide structure 53 which is further coupled fast to the roll support 40 and which accommodates the carriage 42 so as to allow its reciprocating motion therein in a manner set forth presently. The carriage 42 rotatably supports an upstanding shaft 54 via bearings 56. The shaft 54 extends upwardly of the carriage 42 through a slot 58 in a top wall 60 of the guide structure 53 and has the movable feed roll 36 nonrotatably mounted on its top end. The guide structure 53 has a pair of opposed side walls 62 each having defined therein a guide slot 64 extending horizontally and transversely of the predetermined path of the bar 10. Rollably engaged in each guide slot 64 are a pair of rollers 66 each rotatably mounted on one end of a shaft 68 extending through the carriage 42. Consequently, the carriage 42 is reciprocably rollable along the pair of guide slots 64. As the carriage 42 so reciprocates, so does the movable feed roll 36, rotatably supported thereon, toward and away from the fixed guide roll 34. Employed for such back and forth travel of the carriage 42 together with the movable feed roll 36 is a fluid actuated cylinder 70 mounted to a rear wall 72, away from the roll support 40, of the guide structure 53. The fluid actuated cylinder 70 has its piston rod 74 coupled to the carriage 42.

It will be also observed from FIG. 5 that a rod 76 extends from the rear wall 72 of the guide structure 53 in a direction away from and at right angles with the predetermined bar path. The rod 76 slidably extends through a bore 78 in a lug 80 on the platform 44. A helical compression spring 82 acts between a spring seat 84 held against the lug 80 and another spring seat 86 formed by a collar on the end of the rod 76 away from the guide structure 53. Thus the compression spring 82 biases the guide structure 53, and in consequence the slide base 38 and the two feed rolls 34 and 36 thereon, rightwardly as seen in FIG. 5, normally holding the slide base in the illustrated position where it abuts against a stop 88 forming a part of the guide 46. When the slide base 38 is in this normal position, the fixed guide roll 34 is contiguous to the predetermined path of the bar 10, as best seen in FIG. 3. The slide base 38 will travel transversely of the bar path against the bias of the compression spring 82 when a transverse force is exerted on the fixed guide roll 34 by the bar 10 when the latter is being cut by the cutting mechanism 18.

FIG. 5 also indicates that the shaft 50 carrying the fixed feed roll 34 has a portion 90 extending downwardly through a clearance hole 92 in the slide base 38 and through two registered slots 94 and 96 in the guide 46 and platform 44. The shaft 54 carrying the movable feed roll 36 likewise has a portion 98 extending downwardly through three registered slots 100, 102 and 104 defined respectively in the slide base 38, guide 46, and platform 44. These downward extensions 90 and 98 are both intended for connection to the drive mechanism 26, as will be detailed subsequently.

Figure 6:
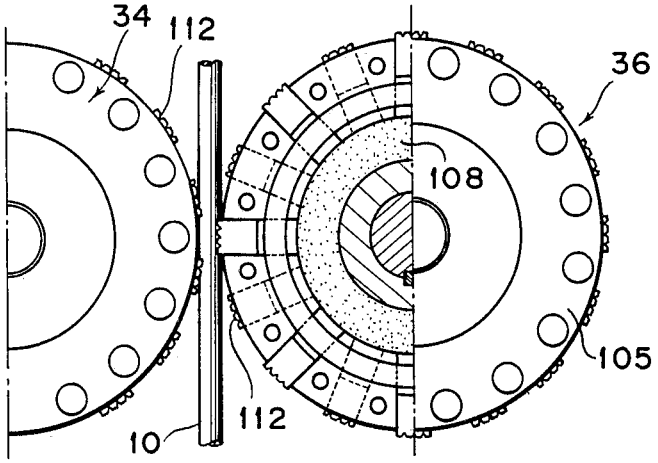
FIG. 6 is a top plan, partly sectioned for clarity, of one pair of feed rolls of the bar cutting apparatus, shown together with a bar engaged therebetween.
Figure 7:
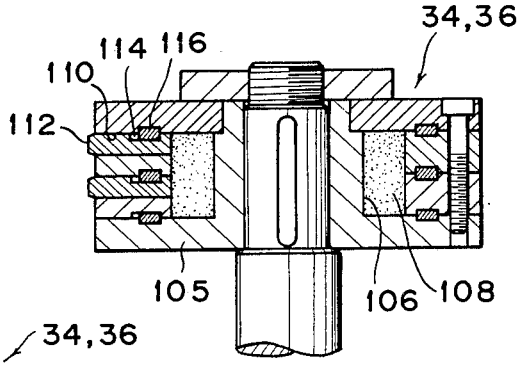
FIG. 7 is an axial section through one of the feed rolls of FIG. 6.
Figure 8:
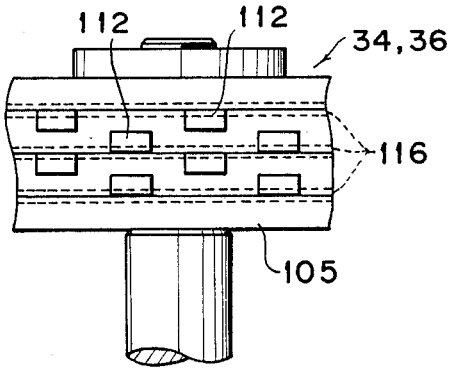
FIG. 8 is a fragmentary elevation of one of the feed rolls.

We invite attention to FIGS. 6, 7 and 8 for a detailed study of the feed rolls 34 and 36, which are therein shown adapted for feeding the ribbed bar 10 of FIGS. 1 and 2. The two feed rolls 34 and 36 can be of like configuration, so that the description of one applies to the other.

As best seen in FIG. 7, each feed roll has a body 105 defining a tubular hollow 106 packed with an elastomeric body 108 such as that of polyurethane rubber. The feed roll body 104 has further defined therein a plurality or multiplicity of slotlike openings 110 in several circumferential rows staggered with respect to one another. Each opening 110 extends between the outer surface of the feed roll body 104 and the tubular hollow 106 therein. Slidably engaged in each opening 110 is a tooth 112 normally partly protruding outwardly therefrom by having its inner end held against the elastomeric body 108. Each tooth 112 has a keyway 114 in which is slidably engaged one of annular keys 116 rigidly supported by the feed roll body 104 in concentric relation therewith. The teeth 112 can thus recede into the feed roll body 104, to an extent determined by the relative radial dimensions of the keyways 114 and keys 116, against the resistive force of the elastomeric body 108.

We have so far described the downstream side feed mechanism 24. The upstream side feed mechanism 22, then, differs from the downstream side feed mechanism 24 in that its pair of feed rolls 34' and 36' are not jointly movable transversely of the predetermined path of the ribbed bar 10, although of course the feed roll 36' is movable toward and away from the feed roll 34'. Thus, while the shaft 50' of the fixed feed roll 34' is rotatably supported by the roll support 40' rigidly mounted on the platform 44, the shaft 54' of the movable feed roll 36' is rotatably supported by the carriage 42' rollable within the guide structure 53'. FIG. 4 clearly illustrates the rolling engagement of the carriage 42' with the guide structure 53'. A fluid actuated cylinder 70' actuates the movable feed roll 36' toward and away from the fixed feed roll 34'.

Drive Mechanism

The drive mechanism 26 for the two pairs of feed rolls 34 and 36, and 34' and 36', includes a motor drive unit 118, FIG. 5, mounted upstandingly on a gear housing 120. Disposed some distance below the platform 44, the gear housing 120 accommodates the gear trains best represented in FIG. 9. As will be noted also from FIG. 5, the motor drive unit 118 has an output shaft 122 protruding into the gear housing 120 and having a drive pinion 124 mounted fast thereon. The drive pinion 124 meshes via an intermediate gear 126 with a pair of driven gears 128 and 130 in series and also with another pair of driven gears 128' and 130' in series. The first pair of driven gears 128 and 130 are nonrotatably mounted on upstanding shafts 132 and 134, and the second pair of driven gears 128' and 130' on upstanding shafts 132' and 134', respectively.

As shown in FIG. 5, the pair of shafts 132 and 134 rotatably extend upwardly of the gear housing 120 and are coupled via universal joints 136 and 138 to links 140 and 142, respectively. These links 140 and 142 are coupled in turn to the shafts 54 and 50 of the downstream side pair of feed rolls 36 and 34 via universal joints 144 and 146, respectively. Although only one driving connection between gear housing 120 and upstream side feed mechanism 22 is seen in FIG. 4, it will nevertheless be understood that the pair of shafts 132' and 134' are coupled via universal joints 136' and 138' to links 140' and 142', and thence to the shafts 54' and 50' of the upstream side pair of feed rolls 36' and 34' via universal joints 144' and 146', respectively.

Operation

Figure 9:
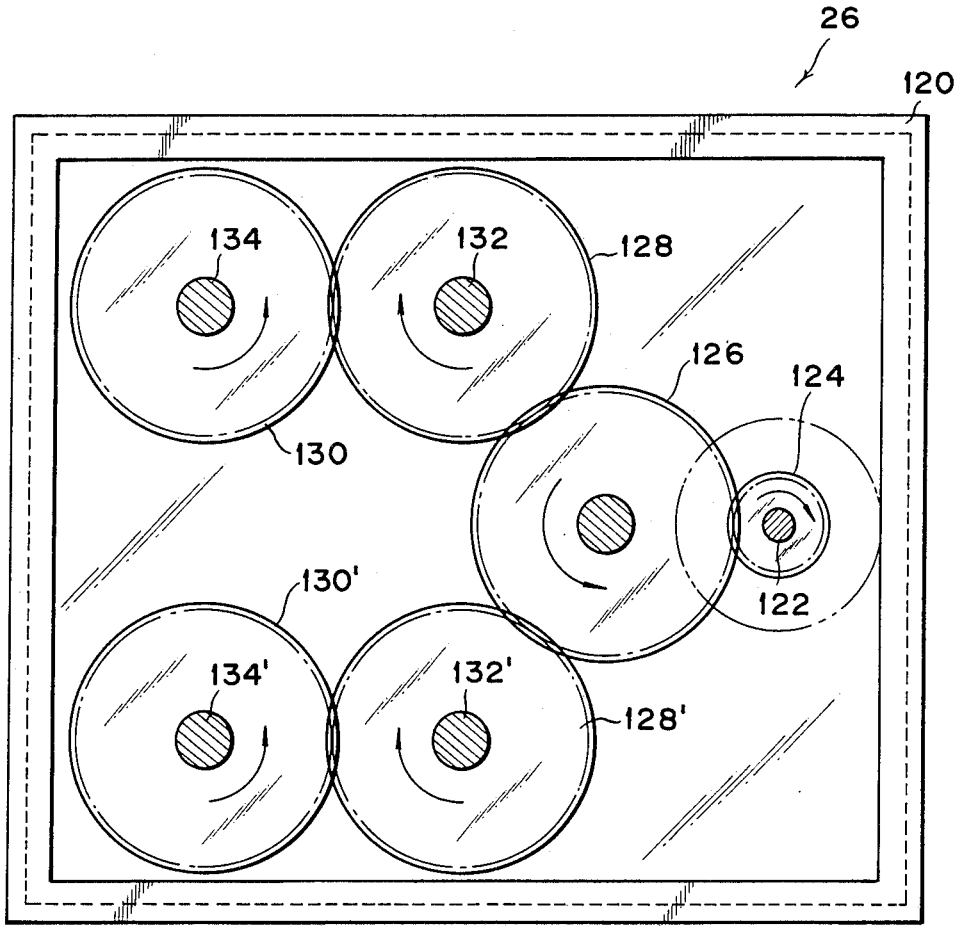
FIG. 9 is a horizontal section through the drive mechanism of the bar cutting apparatus, taken along the line IX—IX in FIG. 4.

As the motor drive unit 118 drives the gearing within the gear housing 120, the pair of driven gears 132' and 134' will rotate in opposite directions, and so will the other pair of driven gears 132 and 134, as indicated by the arrows in FIG. 9. The rotations of the driven gears 132' and 134' are transmitted to the upstream side pair of feed rolls 36' and 34' via the shafts 136' and 138', links 140' and 142', and shafts 54' and 50', respectively, causing the feed rolls 34' and 36' to rotate in the opposite directions indicated by the arrows in FIG. 3. Similarly, the rotations of the driven gears 132 and 134 are transmitted to the downstream side pair of feed rolls 36 and 34 via the shafts 136 and 138, links 140 and 142, and shafts 54 and 50, respectively, causing the feed rolls 34 and 36 to rotate in the opposite directions also indicated by the arrows in FIG. 3.

Let us assume that the ribbed bar 10 to be cut is placed between the upstream side pair of feed rolls 34' and 36', with the movable feed roll 36' positioned away from the fixed feed roll 34'. Then the bar will not be fed in the face of the rotation of both feed rolls 34' and 36'. The fluid actuated cylinder 70' of the upstream side feed mechanism 22 may be extended to move the movable feed roll 36' toward the fixed feed roll 34', with the result that the bar 10 becomes engaged between the two feed rolls 34' and 36'. Then the bar 10 will be fed in the direction of the arrow 20 in FIG. 3, into and through the cutting mechanism 18. The movable feed roll 54 of the downstream side feed mechanism 24 is now held away from the fixed feed roll 34.

As will be understood by referring again to FIG. 6 in particular, the teeth (112) of the upstream side pair of feed rolls 34' and 36' will be resiliently held against the bar 10 to make positive engagement with its ribs. The bar 10 will thus be fed with little or no slip.

The fluid actuated cylinder 70' may be contracted when a required length of the bar 10 is fed as above. The contraction of the cylinder 70' results in the retraction of the movable feed roll 36' away from the fixed feed roll 34' and, consequently, in the termination of the forward travel of the bar 10, even if both feed rolls 34' and 36' remain in rotation. The exact required length of the bar 10 will have been fed as the feed rolls 34' and 36' have positively engaged the bar during its feeding.

Then the cutting mechanism 18 may be actuated to hold the bar 10 with the holder mechanism 32 and to cut off the required length of the bar by the movable cutter 30 in coaction with the fixed cutter 28. During such cutting of the bar 10, the fixed feed roll 34 of the downstream side feed mechanism 24 will be loaded transversely through the bar. Then the feed rolls 34 and 36 will both travel transversely of the bar 10 with the slide base 38 in opposition to the force of the compression nspring 82. This transverse displacement is effective not only to protect the downstream side feed mechanism 24 from destruction but also to prevent the bending of the bar 10.

Then the fluid actuated cylinder 70 of the downstream side feed mechanism 24 may be extended to cause the movable feed roll 36 to travel toward the fixed feed roll 34 and hence to press the severed piece of bar against the fixed feed roll. The piece of bar will thus be transported away from the cutting mechanism 18 by positive engagement with the pair of feed rolls 34 and 36.

One cycle of cutting operation has now be completed. The same cycle may be repeated to cut off the successive required lengths of the bar 10.

We claim:

1. Apparatus for cutting a bar, such as a reinforcing steel bar having a regular pattern of ribs formed thereon, into any required lengths as the bar is fed longitudinally in a predetermined direction along a predetermined path, comprising:

(a) frame means;

(b) a cutting mechanism mounted on the frame means and disposed on the predetermined path of the bar for cutting same when the bar is being held stationary on the path;

(c) a first fixed feed roll rotatably mounted on the frame means and disposed on one side of the predetermined path and on the upstream side of the cutting mechanism with respect to the predetermined traveling direction of the bar;

(d) a first carriage mounted on the frame means for reciprocating movement in a direction at right angles with the predetermined path;

(e) a first movable feed roll disposed opposite the first fixed feed roll across the predetermined path and rotatably mounted on the first carriage for movement therewith toward and away from the first fixed feed roll, the first movable feed roll when moved toward the first fixed feed roll pressing the bar against the first fixed feed roll for feeding the bar forwardly of the predetermined path;

(f) first actuator means for reciprocably moving the first movable feed roll toward and away from the first fixed feed roll;

(g) a slide base disposed on the downstream side of the cutting mechanism with respect to the predetermined traveling direction of the bar and mounted on the frame means for reciprocating movement between a normal and a retracted position in a direction at right angles with the predetermined path;

(h) resilient means for normally holding the slide base in the working position;

(i) a second fixed feed roll rotatably mounted on the slide base and disposed on one side of the predetermined path;

(j) a second carriage mounted on the slide base for reciprocating movement in a direction at right angles with the predetermined path;

(k) a second movable feed roll rotatably mounted on the second carriage for movement therewith toward and away from the second fixed feed roll and, when the slide base is in the normal position, disposed opposite the second fixed feed roll across the predetermined path, the second movable feed roll when moved toward the second fixed feed roll pressing the severed length of bar against the second fixed feed roll for feeding the bar length forwardly of the predetermined path and away from the cutter mechanism;

(l) the second fixed feed roll and the second movable feed roll, with the bar engaged therebetween, being conjointly displaceable with the slide base from the normal to the retracted position thereof against the force of the resilient means when the bar is being cut by the cutting mechanism;

(m) second actuator means for reciprocably moving the second movable feed roll toward and away from the second fixed feed roll;

(n) a drive mechanism for constantly imparting rotation to the first fixed feed roll and the first movable feed roll in opposite directions and to the second fixed feed roll and the second movable feed roll in opposite directions; and wherein the first fixed feed roll, first movable feed roll, second fixed feed roll, and second movable feed roll each have a plurality of teeth arranged circumferentially thereon for engagement with the bar, said teeth being movable radially of each feed roll and further being biased radially outwardly by second resilient means enclosed in each feed roll.

2. A bar cutting apparatus as set forth in claim 1, wherein the second resilient means comprises a tubular body of elastomeric material mounted concentrically within each feed roll.

* * * * *